US006521398B2

(12) United States Patent
Claes et al.

(10) Patent No.: US 6,521,398 B2
(45) Date of Patent: Feb. 18, 2003

(54) SUBBED POLYESTER FILM AND TO IMAGING MATERIALS HAVING SUCH A POLYESTER AS SUPPORT

(75) Inventors: Roland Claes, Dendermonde (BE); Etienne Van Thillo, Essen (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/891,965

(22) Filed: Jun. 26, 2001

(65) Prior Publication Data

US 2002/0037483 A1 Mar. 28, 2002

Related U.S. Application Data

(60) Provisional application No. 60/217,107, filed on Jul. 10, 2000.

(30) Foreign Application Priority Data

Jul. 7, 2000 (EP) ..... 00202408

(51) Int. Cl.[7] ..... G03C 1/765; G03C 1/795; G03C 1/835; G03C 1/83; G03C 1/85

(52) U.S. Cl. ..... 430/519; 430/517; 430/522; 430/527; 430/529; 430/533; 430/534; 430/535; 430/950; 428/143; 428/147; 428/478.3; 428/483; 347/106

(58) Field of Search ..... 430/950, 534, 430/535, 510, 517, 533, 527, 529, 519, 522; 428/143, 147, 478.2, 483; 347/106

(56) References Cited

U.S. PATENT DOCUMENTS

| | | | | | |
|---|---|---|---|---|---|
| 3,615,557 | A | | 10/1971 | D'Cruz | 96/87 R |
| 4,172,731 | A | * | 10/1979 | Heigold et al. | 430/950 |
| 4,980,273 | A | * | 12/1990 | Fautz et al. | 430/950 |
| 5,610,001 | A | * | 3/1997 | Mostaert et al. | 430/533 |
| 5,677,116 | A | * | 10/1997 | Zengerle et al. | 430/535 |
| 6,025,119 | A | | 2/2000 | Majumdar et al. | 430/529 |
| 6,190,821 | B1 | * | 2/2001 | Vandenabeele | 430/950 |

FOREIGN PATENT DOCUMENTS

| | | |
|---|---|---|
| EP | 476 521 | 3/1992 |
| EP | 579 299 | 1/1994 |

* cited by examiner

*Primary Examiner*—Richard L. Schilling
(74) *Attorney, Agent, or Firm*—Joseph T. Guy; Nexsen Pruet Jacobs & Pollard, LLC

(57) ABSTRACT

A polyester film is disclosed comprising on its upper side a latex subbing layer, and a gelatin subbing layer which contains a black spacing agent. This polyester film can be advantageously used as support for several imaging elements, such as photographic materials, (photo) thermographic materials, and ink jet recording elements.

13 Claims, No Drawings

SUBBED POLYESTER FILM AND TO IMAGING MATERIALS HAVING SUCH A POLYESTER AS SUPPORT

The application claims the benefit of U.S. Provisional application No. 60/217,107 filed Jul. 10, 2000.

FIELD OF THE INVENTION

The present invention relates to an improved subbed polyester film and to imaging materials having such a polyester as support.

BACKGROUND OF THE INVENTION

Photosensitive materials based on silver halide chemistry are used in a lot of applications, e.g. photographic materials for general amateur and professional photography in black-and white or colour, recording and printing materials for the motion picture industry, and materials for the recording and duplication of medical diagnostic images. Further specific materials are developed for micrography, non-destructive testing and graphic arts pre-press. In graphic arts reproduction processes the original image appearing to have a continuous tone gradation is reproduced in a screening process by a collection of large number of dots, either by optical means in the case of a camera film or by electronic means in case of a recorder film. Apart from camera and recorder films there exist also so-called contact films which are able to duplicate screened images. In several photographic areas but in particular in graphic arts prepress films there is permanent need for lower manufacturing costs, higher covering power, sharper images, and reduced replenishment rates. This can be achieved in principle by lowering the silver coverage and the thickness of the emulsion layer which implies a low gelatin/silver halide ratio, and lowering the thickness of the auxiliary layers which again implies low gelatin coverages. However, this tendency towards low silver and gelatin coverages can lead to severe problems as will be explained hereinafter.

Conventionally graphic arts photographic materials are coated on a polyester support. The most widely used polyester support in the photographic industry is polyethylene terephthalate. In order to ensure a perfect adhesion of hydrophilic layers such as photographic light-sensitive emulsion layers to dimensionally stable polyester film supports, i.e. polyester films that have been biaxially stretched and heat-setted, it is known for long time to apply several intermediate layers between the support and the light-sensitive emulsion layer(s). In most cases two intermediate layers are needed. A first one, known as the adhesive layer or primer layer or resin subbing layer or latex subbing layer, shows a good adhesion to the polyester film and at the same time possesses good attaching properties in respect to the second layer, known as the "gelatin subbing layer" or "gelatin sub layer" or "gel sub layer", which usually is formed to a great extent of a hydrophilic colloid such as gelatin. For sake of uniformity we will further refer to the first intermediate layer defined above as the latex subbing layer and to the second intermediate layer as the gelatin subbing layer.

It is customary to incorporate in the gelatin subbing layer a certain amount of a spacing agent, also called matting agent, in order to give the surface a certain degree of roughness. When such a spacing agent is absent bad winding up and lateron bad unwinding of the finished polyester is to be expected. In order to be effective such spacing agents must show a certain minimal average particle size, preferably about 3 $\mu$m. However, when using a very thin emulsion layer the top of the spacing agent particles will pierce through the surface of the emulsion layer. When the emulsion layer is exposed and developed each spacing particle piercing through will locally interrupt the black density of the developed silver. When inspected by light in transmittance this gives the so-called "starry night" effect. The problem can be alleviated by choosing less or a smaller spacing agent. However, then the problems with winding up and unwinding must be expected to deteriorate. So there is a need for a solution which avoids the starry night effect but retains the beneficial properties of the presence of the spacing agent.

OBJECTS OF THE INVENTION

It is an object of the present invention to provide a polyester support free of problems of winding up and unwinding.

It is a further object of the present invention to provide imaging elements, such as a photographic material, which are free of the starry night effect after processing.

SUMMARY OF THE INVENTION

The above mentioned objects are realised by providing a polyester film having upper and back sides, the upper side bearing, in order, (a) a latex subbing layer, (b) a gelatin subbing layer, characterized in that at least one of said subbing layers (a) and (b) comprises a black spacing agent. Preferably the black spacing agent is incorporated in the gelatin subbing layer (b).

In a preferred embodiment this spacing agent consists of hydrophobic polymeric particles loaded with a mixture of one or more cyan, magenta and yellow dyes in such a mutual ratio that black is obtained. In a further preferred embodiment the polyester film carries on its back side a conductive latex subbing layer (c) and a gelatinous antihalation layer (d).

The polyester film according to the invention can favourably serve as support for several imaging systems, such as a photographic material, a (photo)thermographic material, and an ink jet recording material. Further advantages and embodiments of the present invention will become apparent from the following description.

DETAILED DESCRIPTION OF THE INVENTION

The different elements constituting the present invention will now be explained in detail.

The Black Spacing Agent

It is the essence of the present invention that one of the subbing layers, most preferably the gelatin subbing layer (b), contains a black spacing agent.

In a most preferred embodiment the black spacing agents consists of hydrophobic polymer particles or beads, which are loaded with a mixture of cyan, magenta and yellow hydrophobic dyes in such a mutual ratio that the spacing particles appear black.

Methods for associating hydrophobic ingredients, such as hydrophobic dyes, whiteners, and colour couplers, with hydrophobic polymer particles have been described in e.g. U.S. Pat. Nos. 4,230,716, 4,214,047, 4,247,627, 4,304,769 and GB 1504949.

A particularly preferred method for use in the present invention is disclosed in EP 483416. This improved method for making aqueous dispersions of hydrophobic polymer particles loaded with at least one hydrophobic compound comprises the following steps:

dissolving the hydrophobic compound in a water-immiscible organic solvent, dispersing the solution obtained in an aqueous medium, mixing the resulting dispersion with a dispersion of hydrophobic particles in another aqueous medium, stirring the mixture obtained to allow the hydrophobic compound to associate the hydrophobic polymer particles, and removing the water-immiscible solvent by evaporation.

In practice any of the numerous combinations of hydrophobic cyan, magenta and yellow dyes can be used provided that they can be combined in an appropriate ratio so that the polymeric particle becomes black. In a particularly preferred embodiment a combination of following dyes is used:

Magenta dye (m1)

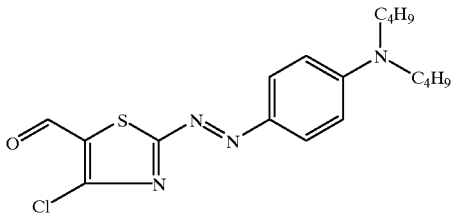

Yellow dye (y1)

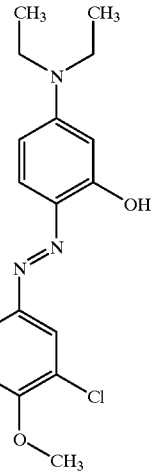

Cyan dye (c1)

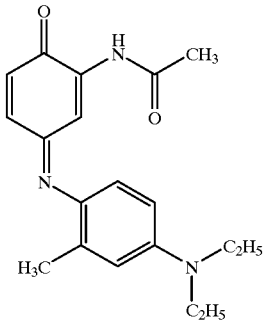

Preferred loadable polymer particles include homopolymers or copolymers of acrylic acid, methacrylic acid, and salts and esters thereof, polystyrene, copoly(ethyl acrylate/stearyl methacrylate), copoly(methacrylic acid/methyl methacrylate/stearyl methacrylate), and polymers described in U.S. Pat. No. 4,614,708 and U.S. Pat. No. 4,861,808 mentioned above.

In a most preferred embodiment poly(methyl methacrylate) (PMMA) is used as loadable spacing agent.

Composition of Layers (a) to (d) Coated on the Polyester

An essential ingredient of the latex subbing layer (a) is an adhesion promoting latex. A preferred class of latex polymers for this purpose are vinylidene chloride-containing copolymers having carboxyl functional groups. Illustrative of such polymers are (1) copolymers of vinylidene chloride and an unsaturated carboxylic acid such as acrylic or methacrylic acid, (2) copolymers of vinylidene chloride and a half ester of an unsaturated carboxylic acid such as the monomethylester of itaconic acid, (3) terpolymers of vinylidene chloride, itaconic acid and an alkyl acrylate or methacrylate such as ethyl acrylate or methyl methacrylate, and (4) terpolymers of vinylidene chloride, acrylonitrile or methacrylonitrile and an unsaturated carboxylic acid such as acrylic acid or methacrylic acid.

In a most preferred embodiment the latex polymer is co(vinylidene chloride-methyl acrylate-itaconic acid; 88%/10%/2%). This copolymer is prepared by emulsion polymerization using 0.5% MERSOLAT H (trade-mark of Bayer AG) as emulsifying agent. It is necessary to add extra surfactant, a so-called post-stabilizer, to the latex in order to assure a good stability on storage. An excellent storage stability is obtained when 4% of ULTRAVON W, trade mark of Ciba-Geigy, is used.

As a further preferred ingredient of the coating solution of the latex subbing layer colloidal silica may be added as a binder. A preferred compound is KIESELSOL 100F. (trade-mark of Bayer AG), average particle size 25–30 nm. The ratio of the amount of latex to silica is preferably about 80/20.

The dry thickness of the latex subbing layer is preferably about 0.1 mm.

The latex subbing layer may contain the black spacing agent but more preferably the agent is incorporated in the gelatin subbing layer which is described hereinafter.

The gelatin subbing layer (b) is coated on top of the the latex subbing layer (a). Apart from the spacing agent the gelatin subbing layer (b) preferably contains a mixture of gelatin and colloidal silica. A preferred compound is again KIESELSOL 300F (trade-mark of Bayer AG). A plasticizing compound can be used in order to avoid the formation of cracks in the dried layer due to the occurence of excessive shrinking of the layer during drying. Plasticizing agents are well-known in the art. Low-molecular weight compounds (e.g. acetamide, glycerin) as well as polymeric latices (e.g. polyethylacrylate, poly-n.-butylacrylate) can be used for this purpose. Furtheron the gelatin subbing layer may contain one or more surfactants. Useful surfactants include: ULTRAVON™ W, an aryl sulfonate from CIBA-GEIGY; ARKOPAL™ N060 (previously HOSTAPAL™ W), a nonylphenylpolyethylene-glycol from HOECHST.

The thickness of the gelatin subbing layer is preferably comprised between 0.1 and 1 $\mu$m.

In a preferred embodiment the polyester film further carries a second latex subbing layer (c) on its back side. This latex subbing layer is preferably of similar composition as the the latex subbing layer (a) on the upper side. However, in a particularly preferred embodiment this layer further contains a conductive polymer in order to make the layer antistatic. The nature of this conductive compound will now be explained in detail.

Such a compound, usually a polymer, can show ionic or electronic conductivity.

The conductivity however of an antistatic layer containing ionic conductive polymers, even after cross-linking, is moisture dependent. Therefore electronically-conducting conjugated polymers have been developed. Substances having electronic conductivity instead of ionic conductivity have a conductivity independent from moisture. They are particularly suited for use in the production of antistatic layers with permanent and reproducible conductivity.

Many of the known electronically conductive polymers are highly coloured which makes them less suited for use in photographic materials, but some of them of the group of the polyarenemethylidenes, e.g. polythiophenes and polyisothianaphthene are not prohibitively coloured and transparent, at least when coated in thin layers. As a result polythiophene derivatives are a preferred type of conductive compounds for use in the present invention.

The production of conductive polythiophenes is described in preparation literature mentioned in the above mentioned book: "Science and Applications of Conducting Polymers", p. 92.

For ecological reasons the coating of antistatic layers should proceed where possible from aqueous solutions by using as few as possible organic solvents. The production of antistatic coatings from aqueous coating compositions being dispersions of polythiophenes in the presence of polyanions is described in EP 0 440 957. Thanks to the presence of the polyanion the polythiophene compound is kept in dispersion.

Preferably said polythiophene has thiophene nuclei substituted with at least one alkoxy group, or —$O(CH_2CH_2O)_nCH_3$ group, n being 1 to 4, or, most preferably, thiophene nuclei that are ring closed over two oxygen atoms with an alkylene group including such group in substituted form.

Preferred polythiophenes for use according to the present invention are made up of structural units corresponding to the following general formula:

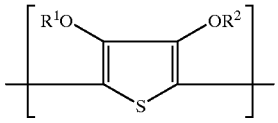

in which:

each of $R^1$ and $R^2$ independently represents hydrogen or a $C_{1-4}$ alkyl group or together represent an optionally substituted $C_{1-4}$ alkylene group or a cycloalkylene group, preferably an ethylene group, an optionally alkyl-substituted methylene group, an optionally $C_{1-12}$ alkyl- or phenyl-substituted 1,2-ethylene group, a 1,3-propylene group or a 1,2-cyclohexylene group.

The most preferred compound is poly(3,4-ethylenedioxythiophene), (PEDT) with following formula:

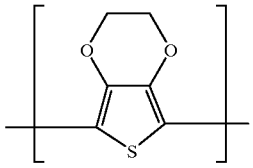

The preparation of said polythiophene and of aqueous polythiophene-polymeric polyanion dispersions containing said polythiophene is described in EP 0 440 957, cited above.

Suitable polymeric polyanion compounds required for keeping said polythiophenes in dispersion are provided by acidic polymers in free acid or neutralized form. The acidic polymers are preferably polymeric sulphonic acids. Examples of such polymeric acids are polymers containing vinyl sulfonic acid and styrene sulfonic acid or mixtures thereof.

The anionic acidic polymers used in conjunction with the dispersed polythiophene polymer have preferably a content of anionic groups of more than 2% by weight with respect to said polymer compounds to ensure sufficient stability of the dispersion. Suitable acidic polymers or corresponding salts are described e.g. in DE-A-25 41 230, DE-A-25 41 274, DE-A-28 35 856, EP-A-14 921, EP-A-69 671, EP-A-130 115, U.S. Pat. No. 4,147,550, U.S. Pat. No. 4,388,403 and U.S. Pat. No. 5,006,451.

The weight ratio of polythiophene polymer to polymeric polyanion compound(s) can vary widely, for example from about 50/50 to 15/85.

The most preferred polymeric polyanion for use in combination with the polythiophene derivative, e.g. PEDT, is polystyrene sulphonate (PSS).

The conductive latex subbing layer (c) has preferably a dry thickness of about 0.1 mm.

In a further preferred embodiment the polyester film further comprises on its back side a gelatinous antihalation layer (d) coated on top of the second subbing layer (c). Apart from the antihalation dye the coating composition typically contains gelatin, a matting agent, and surfactants.

The presence of an antihalation dye is advantageous when the subbed polyester film is used as support for a photosensitive element. Antihalation dyes improve the image sharpness by diminishing the upward reflection of light by the support into the emulsion layer. Useful dyes absorbing in the visible spectral region include the coloured piments of U.S. Pat. No. 2,697,037, the pyrazonol oxonol dyes of U.S. Pat. No. 2,274,782, the styryl and butadienyl dyes of U.S. Pat. No. 3,432,207, the diaryl azo dyes of U.S. Pat. No. 2,956,879, the merocyanine dyes of U.S. Pat. No. 2,527,583, the merocyanine and oxonol dyes of U.S. Pat. No. 3,486,897, U.S. 3,652,284 and U.S. 3,718,472, and the enaminohemioxonol dyes of U.S. Pat. No. 3,976,661. Dyes absorbing in the red spectral region of the di- or triphenylmethane type, some of which bear an electron-withdrawing group, are disclosed in e.g. GB 769749, U.S. Pat. No. 2,282,890, DE 1038395, FR 2,234,585, JP-A 59-228250, U.S. Pat. No. 2,252,052 and A. Guyot, Compt. Rend., Vol 114 (1970), p.1120. Some of the compounds disclosed contain one or more water-solubilizing groups.

It can be advantageous that the antihalation dye is non-diffusible under normal coating conditions and only becomes diffusible and/or discolours under alkaline processing conditions. Such dyes can be incorporated as dispersions or as so-called microcrystalline solid particles. Non-diffusible or hardly diffusible dyes of this type are described in e.g. U.S. Pat. No. 4,092,168, EP 274723, EP 276566, EP 294461, EP 299435, GB 1563809, EP 015601, U.S. Pat. No. 4,857,446, JP-A 02-259752, JP-A 02-264247, EP 582753, EP 587229.

The colour of the antihalation dye will be chosen in function of the spectral sensitivity distribution of the photosensitve element for which the subbed polyester film will serve as a support. For example, when this photosensitive element is a red sensitized photographic film, e.g. a graphic arts recorder film, then a blue antihalation dye will be incorporated.

The dry thickness of the gelatinous antihalation layer is preferably comprised between 0.5 and 4 $\mu$m.

Manufacturing of the Subbed Polyester Film

The layers (a) and (b), and the optional layers (c) and (d) can be coated by any of the well-known coating techniques such as dip coating, air knife coating, slide hopper coating, curtain coating and extrusion coating.

In the particularly preferred embodiment wherein all four layers (a) to (d) are present these layers are coated "on line" in a continuous process in the manufacturing alley of the polyester itself. Molten polyester is extruded and longitudinally stretched. Then the first latex subbing layer (a) is applied on the upper side and the second latex subbing layer (c), optionally conductive, is applied on the back side. Then the subbed polyester is stretched in the transversal direction. The layer (b) optionally containing the black spacing agent is applied on the upper side, and finally the gelatinous antihalation layer (d) is applied on the back side.

Imaging Systems Having the Subbed Polyester as Support (a) Support for a Photographic Material The most important application of the subbed polyester according to the present invention is as support of a conventional silver halide photographic material.

It is explicitly contemplated that such a photographic material belongs to the scope of the present invention.

In this application one or more silver halide emulsion layers and one or more anti-abrasing layers are coated on top of the gelatin subbing layer (b) of the polyester.

The halide composition of the silver halide emulsions used in accordance with the present invention is not specifically limited and may be any composition selected from e.g. silver chloride, silver bromide, silver iodide, silver chlorobromide, silver bromoiodide, and silver chlorobromoiodide. In a prefered embodiment however, the photographic material is a graphic arts material, most preferably, a graphic arts recording material, which by definition is suited for the recording of screened images, linework and/or text electronically stored in an image-setter or scanner. Graphic arts recording materials preferably use emulsions containing a majority of chloride, preferably between 50 mole % and 95 mole %, most preferably between 60 mole % and 89 mole %, and a low amount of iodide, the remaining halide being bromide.

The photographic emulsion(s) can be prepared from soluble silver salts and soluble halides according to different methods as described e.g. by P. Glafkidès in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). They can be prepared by mixing the halide and silver solutions in partially or fully controlled conditions of temperature, concentrations, sequence of addition, and rates of addition. The silver halide can be precipitated according to the single-jet method, the double-jet method, the conversion method or an alternation of these different methods.

The silver halide emulsions can be doped with various metal salts or complexes such as Rhodium and Iridium dopants.

The emulsion can be desalted in the usual ways e.g. by dialysis, by flocculation and re-dispersing, or by ultrafiltration.

The light-sensitive silver halide emulsions are preferably chemically sensitized as described e.g. in the above-mentioned "Chimie et Physique Photographique" by P. Glafkidès, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners, gold-selenium ripeners or by means of reductors e.g. tin compounds as described in GB 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The light-sensitive silver halide emulsions can be spectrally sensitized with proper dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes.

The silver halide emulsion(s) for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are disclosed in *Research Disclosure* Item 36544, September 1994, Chapter VII.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

The binders of the photographic element, especially when the binder used is gelatin, can be hardened with appropriate hardening agents such as those of the epoxide type, those of the ethylenimine type, those of the vinylsulfone type e.g.1, 3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952.

The photographic material of the present invention may further comprise various kinds of surface-active agents and lubricants in the photographic emulsion layer or in another hydrophilic colloid layer. Suitable surface-active agents and lubricants are disclosed in *Research Disclosure* Item 36544, September 1994, Chapter IX.

The present invention is particularly useful in photographic materials having a thin emulsion layer, e.g. thinner than 2 $\mu$m so that the spacing agent present in the gelatin subbing pierces through the surface of that emulsion layer. A particularly preferred embodiment with such a thin emulsion layer is a graphic arts recording material with following material characteristics. The emulsion layer on top of the gelatin subbing layer (b) contains only 5 g/m$^2$ of silver (expressed as $AgNO_3$) of a chlorobromide emulsion with a few iodide, and only about 1 g of gelatin/m$^2$ and about 15% of a polymer latex. A first anti-abrasion layer contains 0.5 g of gelatin/m$^2$ and 0.5 g of a latex. A second anti-abrasion layer contains 0.5 g of gelatin/m$^2$. The black spacing agent, being poly(methyl methacrylate) beads loaded with a mixture of a cyan, magenta and yellow dye prevent the occurrence of the "starry night" effect after processing. The back latex subbing layer is conductive, and the gelatinous antihalation layer contains a blue dye. More detalis will be given in the examples lateron.

(b) Support for a (Photo)thermographic Material.

A thermosensitive element contains a substantially light-insensitive silver salt of an organic carboxylic acid, a reducing agent therefor in thermal working relationship therewith and a binder. By thermal working relationship with one another is meant that during the thermal development process the reducing agent must be present in such a way that it is able to diffuse to the particles of substantially light-insensitive silver salt of an organic carboxylic acid so that reduction thereof can take place. A thermosensitive element is exposed by heat mode by means of a thermal head.

When the thermosensitive element further contains a photosensitive silver halide in catalytic amounts the thermographic recording material is turned into a photothermographic material ("Dry Silver") which is exposed in photo mode.

Preferred substantially light-insensitive silver salts of an organic carboxylic acid are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention.

Preferred water-dispersible binders are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders are water-dispersible film-forming polymers with covalently bonded moieties with one or more acid groups.

The above mentioned binders or mixtures thereof may be used in conjunction with waxes or "heat solvents" also called "thermal solvents" or "thermosolvents" improving the reaction speed of the redox-reaction at elevated temperature.

Suitable organic reducing agents are organic compounds containing at least one active hydrogen atom linked to O, N or C, such as is the case with, aromatic di- and tri-hydroxy compounds; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Catechol-type reducing agents, i.e. reducing agents containing at least one benzene nucleus with two hydroxy groups (—OH) in ortho-position, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP 692733 and EP 903625 being particularly preferred. Other suitable reducing agents are sterically hindered phenols, bisphenols and sulfonamidophenols.

Combinations of reducing agents may also be used that on heating become reactive partners in the reduction of the substantially light-insensitive silver salt or an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

The (photo)thermographic materials can further contain toning agents, stabilizers, pigments, optical brighteners and surfactants.

It is again understood that the use of the particular polyester support of the present invention is particularly advantageous when the (photo)thermosensitive layer is a thin layer of at most 2 $\mu$m.

(c) As Support for an Ink Jet Material

Ink jet recording materials comprise a support and an ink-receptive layer. This latter layer usually contains a binder, a pigment, preferably a porous filler, and optionally other ingredients such as surfactants, polymer latices, plasticizers and mordants to hold the dye of the ink.

Typical binders, well-known in the art include hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinylacetal; polyvinyl pyrrolidone; polyacrylamide; acrylamide/acrylic acid copolymer; styrene/acrylic acid copolymer; ethylene-vinylacetate copolymer; vinylmethyl ether/maleic acid copolymer; poly (2-acrylamido-2-methyl propane sulfonic acid); poly (diethylene triamine-co-adipic acid); polyvinyl pyridine; polyvinyl imidazole; polyimidazoline quaternized; polyethylene imine epichlorohydrin modified; polyethylene imine ethoxylated; poly(N,N-dimethyl-3,5-dimethylene piperidinium chloride; polyethylene oxide; polyurethane; melamine resins; gelatin; carrageenan; dextran; gum arabic;

casein; pectin; albumin; starch; collagen derivatives; collodion and agar-agar.

The pigment present in the ink receiving layer may be chosen from organic material such as polystyrene, polymethylmethacrylate, silicones, urea-formaldehyde condensation polymers, polyesters and polyamides. Preferably however, it is an inorganic porous pigment, such as silica, talc, clay, koalin, diatomaceous earth, calcium carbonate, magnesium carbonate, aluminium hydroxide, aluminium oxide, titanium oxide, zinc oxide, barium sulfate, calcium sulfate, zinc sulfide, satin white, boehmite and pseudo-boehmite.

Ink compositions for ink jet typically include following ingredients: dyes or pigments, water and/or organic solvents, humectants such as glycols, detergents, thickeners, polymeric binders, preservatives, etc.

The ink jet printing process can be performed in several different ways. In a first type of process a continuous droplet stream is created by applying a pressure wave pattern. This process is known as continuous ink jet printing. In a first embodiment the droplet stream is divided into droplets that are electrostatically charged, deflected and recollected, and into droplets that remain uncharged, continue their way undeflected, and form the image. Alternatively, the charged deflected stream forms the image and the uncharged undeflected jet is recollected. In this variant of continuous ink jet printing several jets are deflected to a different degree and thus record the image (multideflection system).

According to a second process the ink droplets can be created "on demand" ("DOD" or "drop on demand" method) whereby the printing device ejects the droplets only when they are used in imaging on a receiver thereby avoiding the complexity of drop charging, deflection hardware, and ink recollection. In drop-on-demand the ink droplet can be formed by means of a pressure wave created by a mechanical motion of a piezoelectric transducer (so-called "piezo method") or by means of discrete thermal pushes (so-called "bubble jet" method, or "thermal jet" method).

It will again be understood that the use of the subbed polyester of the present invention will be particularly advantageous when the ink-receptive layer is a thin layer, and when monochrome black images are to be printed, e.g. in the case of recording of medical diagnostic images by ink jet printing.

EXAMPLES

Preparation of a Black Spacing Agent 4.5 g of cyan dye c1, 7.5 g of magenta dye m1 and 4.5 g of yellow dye y1 were dissolved together in 165 ml of ethyl acetate. This solution was dispersed whilst stirring for 5 minutes at 1200 rounds/min in an aqueous medium containing 390 ml of water and 37.5 ml of a 10% solution of the surfactant ANTAROX 880, trade mark of GAF Co., a nonylphenyloxypenta(ethyleneoxy) non-ionic surfactant. This dispersion was stirred for one hour with 412.5 g of poly(methyl methacrylate) beads having an average particle size of about 3 $\mu$m. Then the ethyl acetate was evaporated and the dispersion was brought to a final weight of 825 g. 100 g of dispersion contained 2 g of dye mixture and 10 g of beads.

Manufacturing of Polyethylene Terephthalate Film with its Different Subbing and Antihalo Layers.

In the polyethylene terephthalate (PET) manufacturing alley molten PET was extruded and longitudinally stretched. At a first coating installation the PET was provided with a first latex subbing layer. This first subbing layer was dried and a second subbing layer was applied on the reverse side of the film. This second subbing layer was dried and the double side coated film base was transversally stretched. As a result the biaxially stretched film base had a thickness of 100 $\mu$m. The first subbing layer contained 162 mg/m$^2$ of the terpolymer of vinylidene chloride/methyl acrylate/itaconic acid (88%/10%/2%), and 40 mg/m$^2$ of colloidal silica (surface area 100 m$^2$/g). The second subbing layer contained 180 mg/m$^2$ of the terpolymer of vinylidene chloride/methyl acrylate/itaconic acid (88%/10%/2%), 20 mg/m$^2$ of colloidal silica (surface area 100 m$^2$/g), and 3.15 mg/m$^2$ of poly(3,4-ethylenedioxy-thiophene)/poly(styrene sulphonate) complex. Then the PET film was coated on the upper side with a gelatin subbing layer. The coating solution of this layer contained water, gelatin, KIESELSOL 300F (trade mark of Bayer AG), the conventional surfactants ULTRAVON W (trade mark of Ciba-Geigy) and ARKOPAL N060 (trade mark of Hoechst AG), and the organic solvents hexyleneglycol and trimethylolpropane.

In the invention sample the coating composition of the gelatine subbing layer further contained the black matting agent the preparation of which is described above. The final layer contained 1 mg/m$^2$ of loaded black PMMA particles.

In similarly prepared comparison samples a poly(methyl methacrylate) spacing agent not loaded with dyes was present, or no spacing agent at all (see table 1).

Then a gelatinous antihalation layer was coated on top of the conductive latex subbing layer on the backside of the PET film. The coating composition of this gelatinous antihalation layer contained water, gelatin, poly(methyl methacrylate) spacing particles of average particle size 5.9 $\mu$m, surfactants and a blue dye according to following formula:

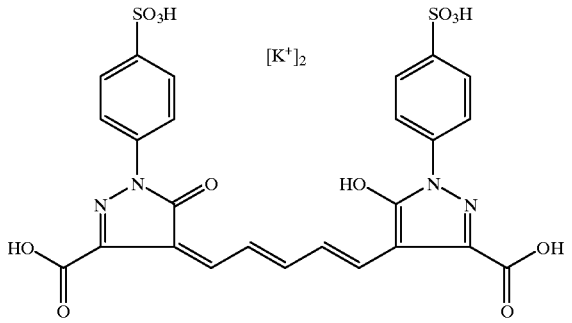

Furtheron the coating composition contained a divinylsulfon hardener.

Preparation of a Photographic Emulsion

To an aqueous gelatin solution (16.7 g gelatin/mol silver) containing sodium chloride, an aqueous solution of silver nitrate and an aqueous halide solution containing potassium bromide, sodium chloride, $2.3\times10^{-7}$ mol/mol silver of $Na_3RhCl_6$ and $3.0\times10^{-7}$ mol/mol silver of $Na_2IrCl_6$ were added with stirring in accordance with a double jet method. A physical ripening was used to form silver chlorobromide grains having an average grain size of 0.27 $\mu$m (variation coefficient: 19%) and a chloride content of 64 mol %. After the physical ripening of the emulsion KI was added to stop crystal growth.

Thereafter, the emulsion was washed using a conventional flocculation method, and then redispersed with 6.67 g/mol silver of gelatin. The resulting emulsion was adjusted to pH 5.3 and then gold/sulfur chemically sensitized at 50° C. by digesting during three hours. The emulsion was stabilized with $8.4\times10^{-3}$ mol/mol silver of 4-Hydroxy-6-Methyl-1,3,3a,7-tetraazaindene, spectrally sensitized with following dye D-1 in an amount of $4.0\times10^{-4}$ mol/mol silver.

D-1

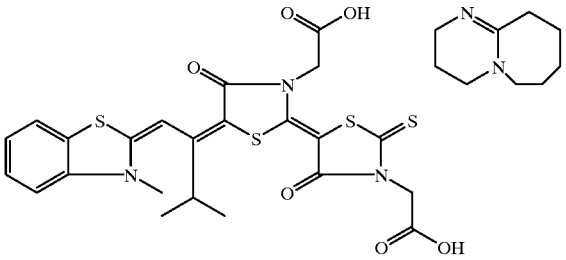

The obtained emulsion has a gelatin/silver ratio of 0.21.

Preparation of Photographic Materials

An emulsion layer, an interlayer and an anti-abrasion layer were simultaneously coated on top of layer (b) of the different subbed polyethylene terephthalate film supports, using a 3-layer arrangement.

The emulsion layer was coated at a silver coverage of 3.23 g of silver per square meter. This layer was then overcoated with an interlayer containing 0.5 g gelatin/$m^2$ and 0.5 g latex/$m^2$, (Co[BuMA-AMPS(Na)]), and further containing stabilizers. An anti-abrasion layer containing 0.5 g gelatin/$m^2$, a hardener, coating aids and a poly(methyl methacrylate) matting agent was applied on top. After the coating the film samples were dried.

Exposure and Photographic Processing

Each sample was exposed by a xenon flash lamp (light emitting time: $10^{-5}$ s.) through both a step wedge and a filter having its peak transmission at 622 nm, and then developed for 15 seconds at 35° C. with developer A (see composition below). Thereafter, each sample was subjected successively to fixation in a conventional ammonium thiosulphate containing fixation bath, and finally washed and dried. The processing took place in a Rapiline 66T3 processor (trade mark of Agfa-Gevaert N.V.).

Composition of developer A

| | |
|---|---|
| Water | 800 ml |
| Potassium carbonate | 29.5 g |
| Potassium sulfite | 34.1 |
| Potasium bromide | 2.4 |
| Diethylene glycol | 14 ml |
| Hydroquinone | 17 |
| Sodium erythrobate | 2.5 |
| 4-Hydroxymethyl-4-methyl-1-phenyl-3-pyrazolidone | 0.275 |
| Methylbenzotriazole | 0.06 |
| Water to adjust the volume to | 1 1 |
| Sodium hydroxide to adjust the pH to | 10.5 |

Evaluation of Starry Night and Maximum Density (Dmax)

The starry night effect was evaluated under a microscope, with an enlargement of 200, according to an arbitrary qualitative scale, result 0 being optimal, and result 5 being prohibitive. Dmax was measured using a densitometer Macbeth TD904. The covering power of the silver was calculated by the following formula:

$$\text{Covering power} = \text{Dmax/coated silver coverage (in } g \text{ silver}/m^2)$$

The obtained data of the samples are represented in Table 1.

TABLE 1

| Support | support matting | Starry night | Covering power | Note |
|---|---|---|---|---|
| 1 | 1 mg/$m^2$ 3 $\mu$m PMMA | 5 | 1.65 | Comparison |
| 2 | 0.3 mg/$m^2$ 3 $\mu$m PMMA | 3 | 1.65 | Comparison |
| 3 | 0.1 mg/$m^2$ 3 $\mu$m PMMA | 1 | 1.62 | Comparison |
| 4 | no matting | 0 | 1.71 | Comparison |
| 5 | 1 mg/$m^2$ 2.2 $\mu$m black PMMA | 0 | 1.69 | Invention |

The sample according to the invention clearly demonstrates an important improvement for the starry night effect. With the black matting the same excellent level of starry night efect is reached as without matting. Also the covering power increases, to the same level as without matting. Summarizing, by the use of the black spacing agent the same quality is reached as without spacing agent. Without matting, the roughness of the support is too low, so that the polyester cannot be handled in the production facility at high coating speeds.

Having described in detail preferred embodiments of the current invention, it will now be apparent to those skilled in the art that numerous modifications can be made therein without departing from the scope of the invention as defined in the appending claims.

What is claimed is:

1. A polyester film having upper and back sides, the upper side bearing, in order, (a) a latex subbing layer, (b) a gelatin subbing layer characterized in that at least one of said subbing layers (a) and (b) comprises a black spacing agent wherein said black spacing agent consists of hydrophobic polymeric particles loaded with a mixture of cyan, magenta and yellow hydrophobic dyes in an appropriate ratio to give a black spacing agent.

2. A polyester film according to claim 1 to wherein said mixture of dyes comprises following dyes:

(cyan dye)

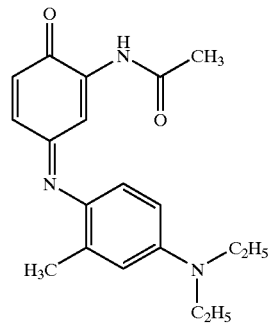

(magenta dye)

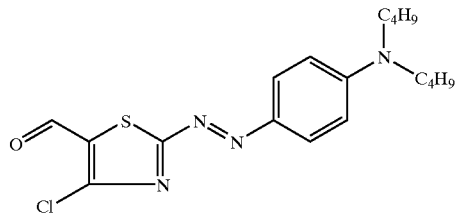

-continued (yellow dye)

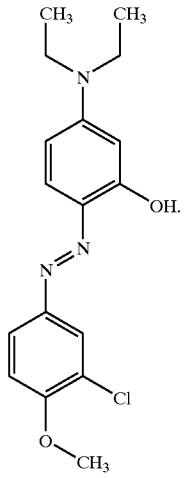

3. A polyester film according to claim 1 wherein said hydrophobic polymeric particles are poly(methyl methacrylate) beads.

4. A polyester film according to claim 1 wherein said black spacing agent is present only in said gelatin subbing layer (b).

5. A polyester film according to claim 1 further comprising on its back side a conductive latex subbing layer (c).

6. A polyester film according to claim 5 wherein said conductive latex subbing layer comprises poly(3,4-ethylenedioxy-thiophene) and poly(styrene sulphonate) as conductive complex.

7. A polyester film according to claim 5 further comprising on top of said conductive latex subbing layer (c) a gelatinous layer (d) comprising an antihalation dye.

8. A polyester film according to claim 1 wherein said polyester film is a polyethylene terephthalate film.

9. A photographic material comprising a support and at least one silver halide emulsion layer wherein said support is a polyester film as defined in claim 1.

10. A photographic material according to claim 9 wherein said silver halide emulsion layer has a dry thickness of at most 2 $\mu$m.

11. A thermographic recording material comprising a support and a thermosensitive layer containing an organic silver salt, a binder and a reducing agent in thermal working relationship therewith, wherein said support is a polyester film as defined in claim 1.

12. A photothermographic recording material comprising a support and a photothermosensitive layer containing silver halide, an organic silver salt, a binder and a reducing agent in thermal working relationship therewith, wherein said support is a polyester film as defined in claim 1.

13. A ink jet recording material comprising a support and an ink-accepting layer, wherein said support is a polyester film as defined in claim 1.

* * * * *